US005228600A

United States Patent [19]

Steijns et al.

[11] Patent Number: 5,228,600

[45] Date of Patent: Jul. 20, 1993

[54] CHILD RESISTANT NOZZLE FOR TRIGGER SPRAYER

[75] Inventors: Emile B. Steijns, Lierop; Petrus L. W. Hurkmans, Someren, both of Netherlands

[73] Assignee: AFA Products Inc., Forest City, N.C.

[21] Appl. No.: 840,765

[22] Filed: Feb. 24, 1992

[51] Int. Cl.[5] ..... B67D 5/00

[52] U.S. Cl. ..... 222/153; 222/380; 222/383

[58] Field of Search ..... 222/153, 321, 380, 383, 222/384, 385, 378; 239/333, 394; 215/221

[56] References Cited

U.S. PATENT DOCUMENTS

| | | | |
|---|---|---|---|
| 4,204,614 | 5/1980 | Reeve | 222/153 |
| 4,257,561 | 3/1981 | McKinney | 222/153 X |
| 4,346,821 | 8/1982 | Wesner et al. | 222/153 |
| 4,516,695 | 5/1985 | Garneau | 222/153 |
| 4,773,567 | 9/1988 | Stoody | 222/153 |
| 5,050,779 | 9/1991 | Knickerbocker | 222/153 |

*Primary Examiner*—Andres Kashnikow
*Assistant Examiner*—A. Pomrening
*Attorney, Agent, or Firm*—Thomas R. Vigil

[57] ABSTRACT

A trigger operated fluid dispensing device for mounting to a container comprising: a body having a front end including opposed side walls at the front end, a nose bushing extending from the front end between the body side walls and at least one, elongate, nozzle cap blocking member which extends from the body front end and which is adapted to engage and prevent rotation of a nozzle cap upon rotation of the cap without manipulation of the body side walls; a nozzle assembly at the body front end including the nose bushing, a nozzle cap received on the nose busing and cooperating structure on or in the nozzle cap and on or in the nose bushing for selectively establishing an off position, a spray position or a stream position of the nozzle cap upon rotation of the nozzle cap; the nozzle cap being mounted for rotation on the nose bushing between the three positions and the nozzle cap having engaging structure therein positioned adjacent the blocking member for engaging the blocking member when someone attempts to rotate the nozzle cap without manipulating the body side walls; and, the side walls of the body at the front end being deflectable inwardly of the body so that when the side walls are squeezed inwardly, they engage and move inwardly the blocking member to permit the engaging structure to move past the blocking member when the nozzle cap is rotated at the same time the body side walls are squeezed.

9 Claims, 5 Drawing Sheets

CHILD RESISTANT NOZZLE FOR TRIGGER SPRAYER

BACKGROUND OF THE INVENTION

1. Field of the Invention

The present invention relates to a trigger operated dispensing device, e.g., a trigger sprayer, for mounting to a storage container, e.g. a bottle A pumping mechanism inside the dispensing device pumps a fluid out of the storage container into the discharge end of the dispensing device upon actuation of a trigger of the device A nozzle assembly is attached to the discharge end and includes a rotatable nozzle cap rotatable to three different discharge positions. A STOP position closes the discharge end, a STREAM position provides a focused stream of fluid, and a SPRAY position provides a spray or fog-like discharge of the fluid.

To avoid access to the contents of the bottle to children, the rotatable nozzle cap remains in the STOP position and cannot be moved easily by children unless the trigger sprayer is manipulated in a special manner. To ensure that the rotating nozzle cap remains in the desired position, i.e. the STOP position, the nozzle cap has at least one internal lug or catch adapted to engage at least one prong or leg extending from a body of the sprayer unless the body is squeezed to deflect the prong or prongs inwardly so the lug inside the cap can be rotated past the prong as the cap is rotated. The lug cannot be disengaged from the prong easily, thereby providing a child resistant trigger sprayer nozzle assembly.

2. Description of the Related Art Including Information Disclosed Under 37 CFR §1.97–1.99

Heretofore, various child resistant nozzle assemblies have been proposed. Some examples of previously proposed child resistant nozzle assemblies are disclosed in the following patents:

| U.S. Pat. No. | Patentee |
|---|---|
| 4,516,695 | Garneau |
| 4,346,821 | Wesner et al. |

The Garneau U.S. Pat. No. 4,516,695 discloses a child resistant nozzle assembly comprising a flexible lever with a shoulder engaging in a notch within a nozzle cap. After pushing the lever, the nozzle cap is free to rotate. After the nozzle cap is back in the desired position, the lever can be pulled back to fix the nozzle cap in the desired position.

In the Wesner et al. U.S. Pat. No. 4,346,821 a nozzle assembly including a planar safety closure is disclosed. The planar safety closure is mounted rotatably on a nose piece at an end portion of a trigger sprayer and is held tightly in place by the passing of an annular ridge on the planar safety closure over an annular lip on the nose piece. A generally flat tab is integrally connected to an overcap. The far end of this tab contains a tooth like detent member which extends rearwardly and is engagable in a slot in a top front wall of a trigger. In this position, the nozzle is locked and cannot easily be opened. To unlock the planar safety closure and to operate the trigger sprayer, the operator has to squeeze the trigger to lift the detent member out of its slot and then has to rotate the planar safety closure for about 180° to a spray position. In this position, the trigger sprayer is ready to work.

The nozzle assembly of the present invention differs from the previously proposed nozzle assemblies by comprising a cap having at least one internal lug which is adapted to engage at least one prong extending from a body of the trigger sprayer to prevent rotation of the cap until the cap is squeezed to deflect the prong inwardly to allow the lug to be rotated past the prong as the cap is rotated. When the nozzle cap is rotated back to the STOP position the lug snaps back into a prong engaging "locked" position and the cap cannot be unlocked by accident such as to a spray position.

SUMMARY OF THE INVENTION

According to the present invention there is provided a trigger operated fluid dispensing device for mounting to a container. The dispensing device comprises a body having a front end including opposed side walls at the front end, a nose bushing extending from the front end between the side walls and at least one, elongate, nozzle cap blocking member which extends from the body front end and which is adapted to engage and prevent rotation of a nozzle cap upon rotation of the cap without manipulation of the body side walls. The device further comprises a nozzle assembly at the front end of the body including the nose bushing, a nozzle cap received on the nose bushing and cooperating structure on or in the nozzle cap and on or in the nose bushing for selectively establishing an off position of the nozzle cap, a spray position of the nozzle cap or a stream position of the nozzle cap upon rotation of the nozzle cap. The nozzle cap is mounted for rotation on the nose bushing between the three positions and the nozzle cap has engaging structure therein positioned adjacent the blocking member for engaging the blocking member when someone attempts to rotate the nozzle cap without manipulating the body side walls. The side walls of the body are deflectable inwardly of the body so that when the side walls are squeezed inwardly, they engage and move inwardly the blocking member to permit the engaging structure in the nozzle cap to move past the blocking member when the nozzle cap is rotated at the same time the body side walls are squeezed.

DESCRIPTION OF THE PREFERRED EMBODIMENT(S)

Figure 1:
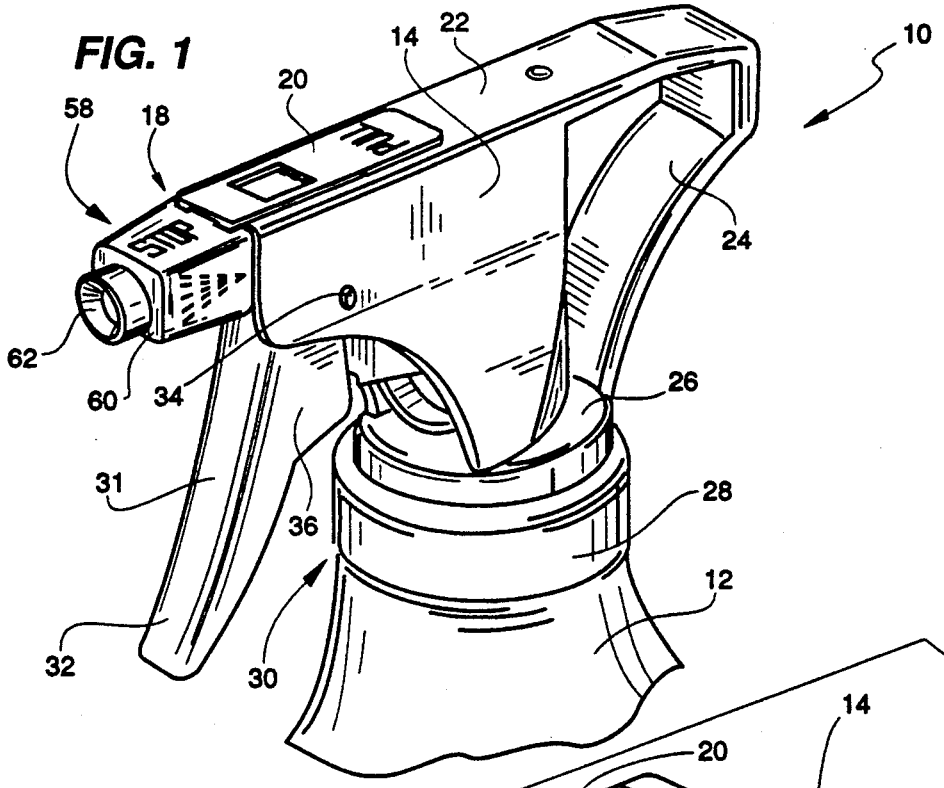
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
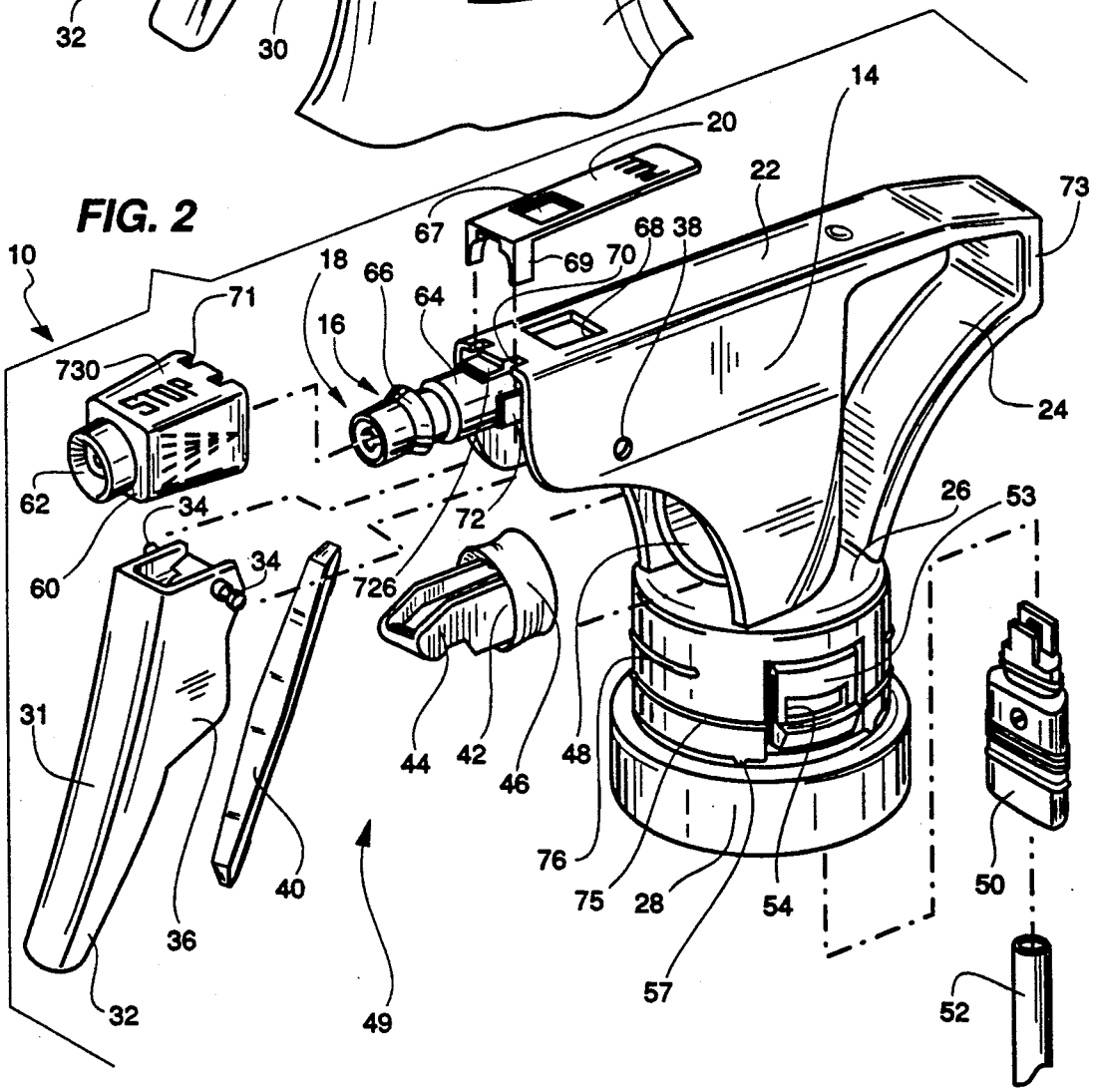
FIG. 2 is an exploded perspective view of the trigger sprayer shown in FIG. 1 and shows a lower locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof or tamper evident pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and cooperating locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove within the locking ring 28 snap-fittingly mates with an annular rib 75 on the base 26. The upper position of the locking ring 28 is the pre-application-to-a-bottle position and the locking ring 28 is held in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
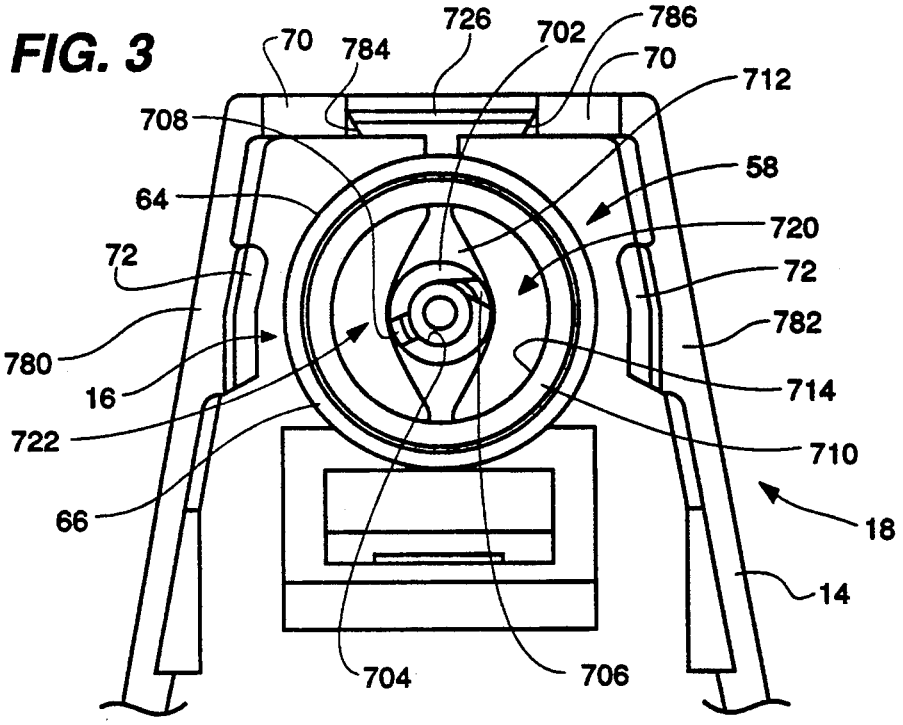
FIG. 3 is a front elevational view of the front end of the sprayer body and a nose bushing that extends from the front end of the body of the trigger sprayer shown in FIG. 2, but without a pull-away piece mounted at the end of the body.

Referring now to FIG. 3, which is a front elevational view of the nose bushing 16, it will be apparent that the nose bushing 16 includes a cylindrical extension 702 having an inner cylindrical cavity 704. The cylindrical extension has a first slot 706 through the cylindrical wall thereof which is a so-called tangential slot for directing liquid tangentially into the cylindrical cavity 704 and has a second, so-called radial, slot 708 for directing liquid radially into the cylindrical cavity 704.

The cylindrical extension 702 is small-in-diameter and is located coaxially with an outer cylinder 710 having a larger diameter. In the embodiment shown in FIG. 3, the smaller cylindrical extension 702 extends outwardly from a web 712 of material which fixes the cylindrical extension 702 in the position shown and defines between, an inner wall 714 of the outer cylinder 710, two waterways 720 and 722 which communicate liquid to be sprayed in a SPRAY or STREAM to the tangential slot 706 or to the radial slot 708.

Figure 4:
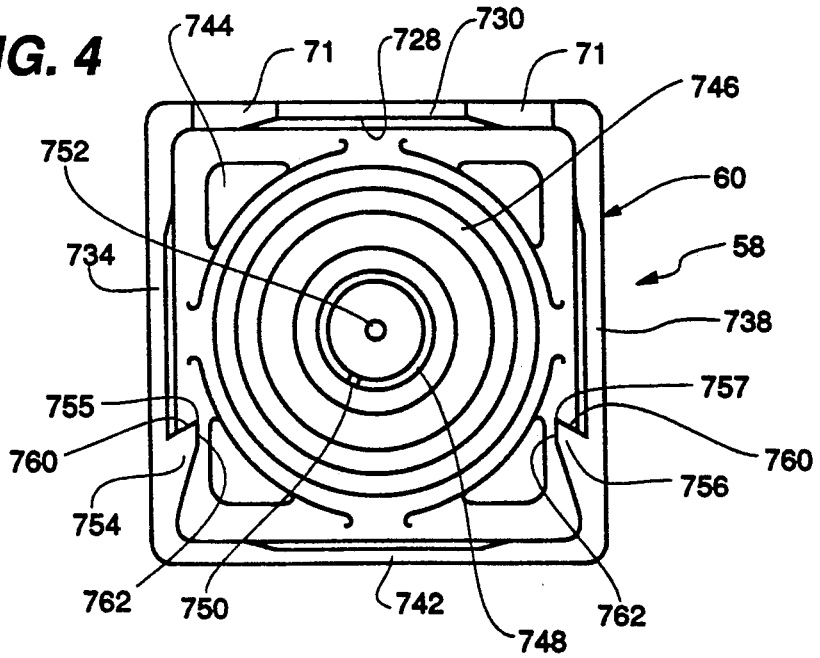
FIG. 4 is a back elevational view of the nozzle cap of a nozzle assembly shown in FIG. 2.
Figure 5:
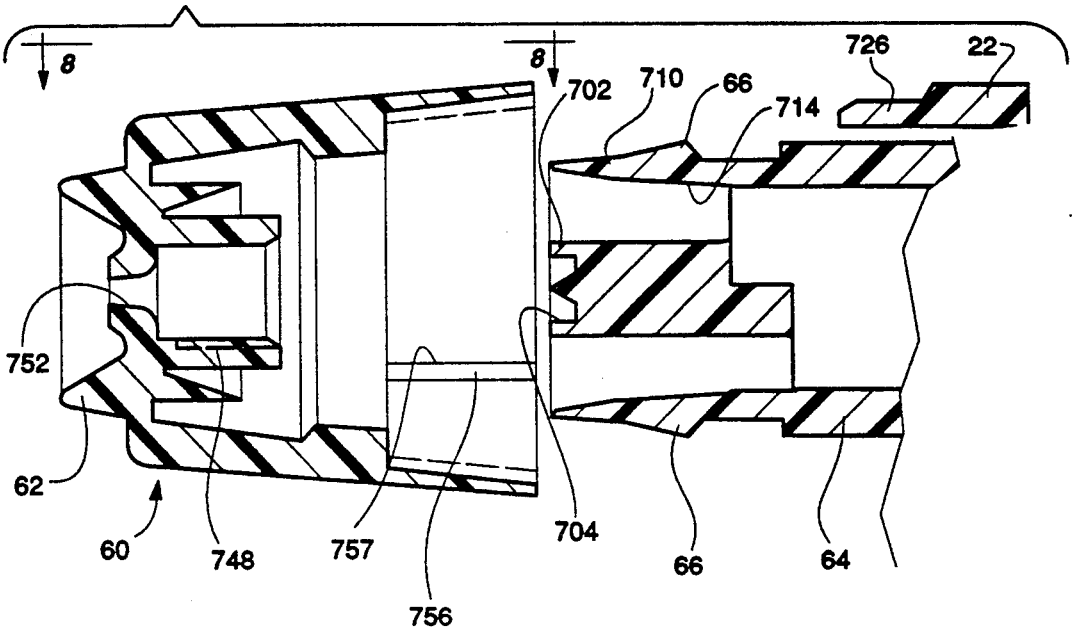
FIG. 5 is an exploded view in longitudinal vertical section of the nozzle cap and nose bushing shown of the nozzle assembly shown in FIG. 2 with portions broken away.
Figure 6:
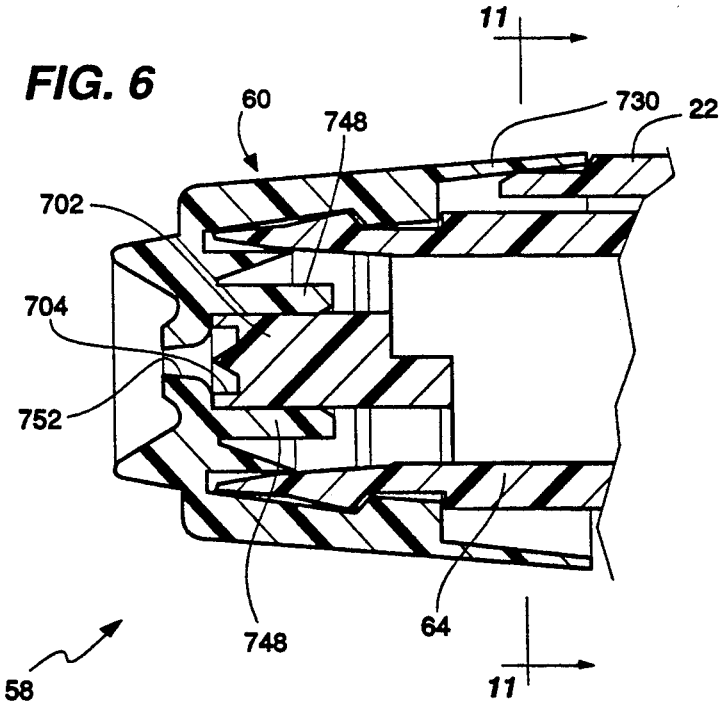
FIG. 6 is a longitudinal, generally vertically sectional view of the nozzle cap and nose bushing coupled together as shown in FIG. 1, with portions broken away.

Also, it will be apparent from FIG. 3 that the top of the body 14 between the slots 70 has a tab extension 726 which extends partially into locating slot 728 in the back underside of a top side wall 730 of the nozzle cap 60 as shown in FIG. 4.

Figure 8:
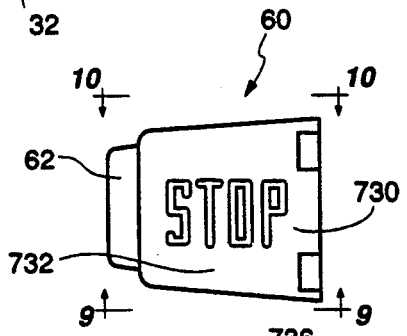
FIG. 8 is a top plan view of the nozzle cap, is taken along line 8—8 of FIG. 5 and shows the indicia STOP on the top side wall of the nozzle cap.
Figure 9:
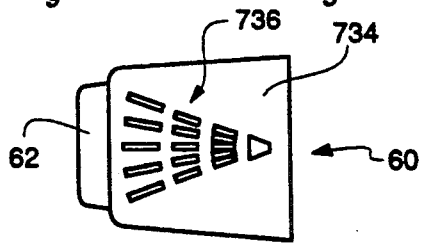
FIG. 9 is a left side elevational view of the nozzle cap shown in FIG. 8, is taken along line 9—9 of FIG. 8 and shows SPRAY indicating indicia on the left side wall of the nozzle cap.
Figure 10:
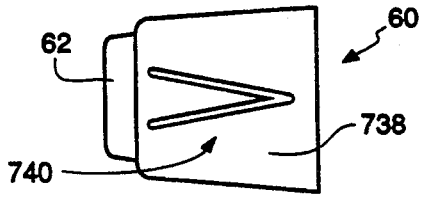
FIG. 10 is a right side elevational view of the nozzle cap shown in FIG. 8, is taken along line 10—10 of FIG. 8 and shows STREAM indicating indicia on the right side wall of the nozzle cap.

With reference to FIG. 4, it will be seen that the nozzle cap 60 has a generally square configuration with the top side wall 730 having STOP indicating indicia 732 as shown in FIG. 8. A left side wall 734 has SPRAY indicating indicia 736 (FIG. 9) thereon and a right side wall 738 which has STREAM indicating indicia 740 (FIG. 10).

Also, the nozzle cap 60 has a bottom wall 742, as shown in FIG. 4.

Within the envelope of the forward portions of the walls 730, 734, 738 and 742 and extending rearwardly from a front wall 744 of the nozzle cap 60 is a first outer cylinder 746 which is adapted to receive therein the outer cylinder 710 of the nose bushing 16. Then, also extending rearwardly from the front wall 744 within the outer cylinder 746 is a smaller-in-diameter cylinder 748 having a slot 750 extending radially therethrough which is adapted, upon selective rotation of the nozzle cap 60, to mate with either the tangential slot 706 or the radial slot 708 in the cylindrical extension 702. The smaller-in-diameter cylinder 748 is adapted to be received over the cylindrical extension 702.

In a manner which is conventional in the art, when the nozzle cap 60 is rotated counterclockwise 90° from the STOP position to the SPRAY position, liquid in the waterway 720 will pass through the slot 750 and through the mating slot 706 into the cylindrical cavity 704 and in a swirl forwardly to an outlet orifice 752 in the front wall 744 of the nozzle cap 60.

Figure 7:
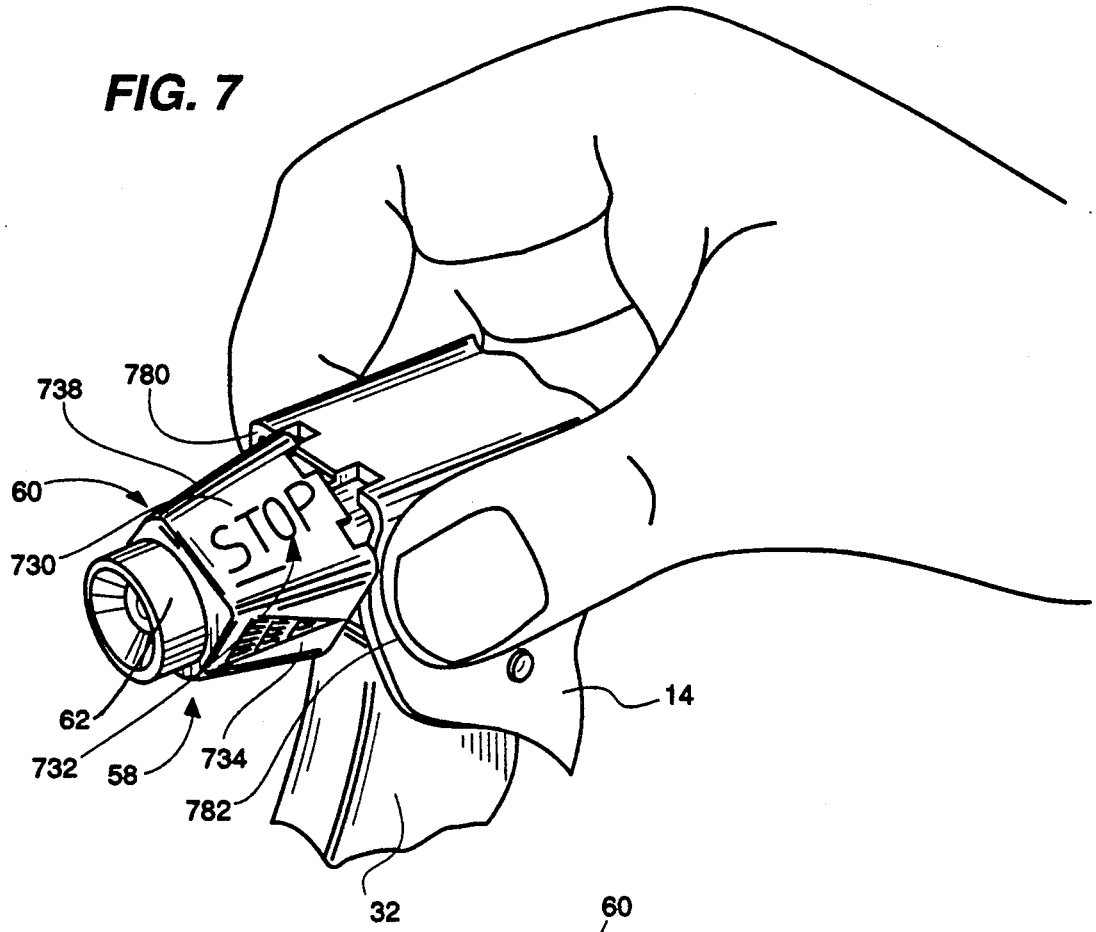
FIG. 7 is a fragmentary perspective view of the trigger sprayer shown in FIG. 1 showing the front discharge end of the trigger sprayer with the nozzle cap partially rotated and showing an operator squeezing the body of the sprayer to permit rotation of the nozzle cap between two positions.

In a similar manner, when the nozzle cap 60 is rotated clockwise 90 from the STOP position to the STREAM position, part of the rotation to this position being shown in FIG. 7, the slot 750 in the wall of the cylinder 748 will mate or register with the radial slot 708 whereby liquid can flow from the waterway 722 through the slot 750 and through the slot 708 radially into the cylindrical cavity 704 and then axially forwardly and out of the orifice 752.

In this way, in a manner similar to previously proposed nozzle assemblies, liquid can be directed through the waterways 720 and 722 to selectively aligned, axially extending or radially extending, slots for communicating liquid in a swirl or in an axial path to the orifice 752 for effecting a desired discharge of liquid in either a conical spray or mist-like discharge or in a substantially axial STREAM type discharge.

Also, it will be understood that different formations can be utilized for effecting the mating of one or more tangential slots through a radial slot to a waterway or one or more radial slots to a radial or longitudinal slot and thence to a waterway, as disclosed in the Quinn et al U.S. Pat. No. 4,234,128 or the Dobbs et al U.S. Pat. No. 4,706,888, the disclosures of which are incorporated herein by reference.

Also in FIG. 4, there is illustrated a first formation 754 in the lower area on the inside of the side wall 734. This formation 754 defines a lug, boss or detent 754 that extends angularly upwardly and inwardly from the wall 734 inside the nozzle cap 60 to an edge or catch 755. In like manner, a lug, boss or detent 756 in the lower area of the wall 738 extends inwardly from the wall 738 inside the nozzle cap 60 to an edge or catch 757.

As will be described in greater detail hereinafter, the lugs 754 and 756 normally are positioned in the nozzle assembly 58 beneath the legs or prongs 72.

The blocking engagement of the legs or prongs 72 relative to the lugs or projections 754 and 756 normally prevents rotation of the nozzle cap 60 of the nozzle assembly 58 until the pull-away piece 20 is pulled away to remove the fork arms 69 from the locking position of each fork arm 69 between the cylindrical portion 64 and a leg or prong 72, and unless and until a user squeezes the side walls of the body 14 in the side wall areas 780 and 782, as shown in FIG. 7 at the same time the user rotates the nozzle cap 60.

Figure 11:
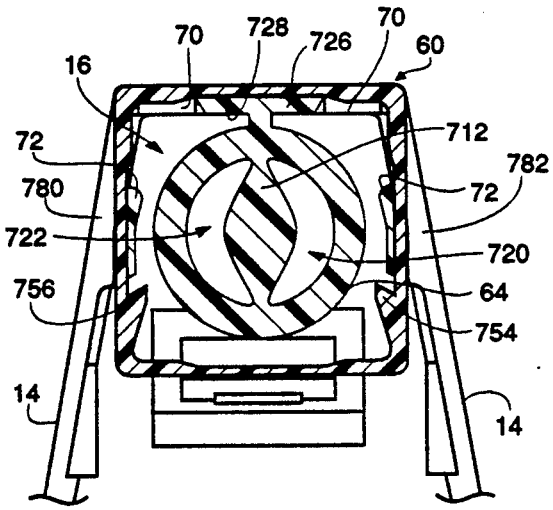
FIG. 11 is a vertical sectional view through the nozzle assembly after a pull-away piece has been removed and is taken along line 11—11 of FIG. 6.
Figure 12:
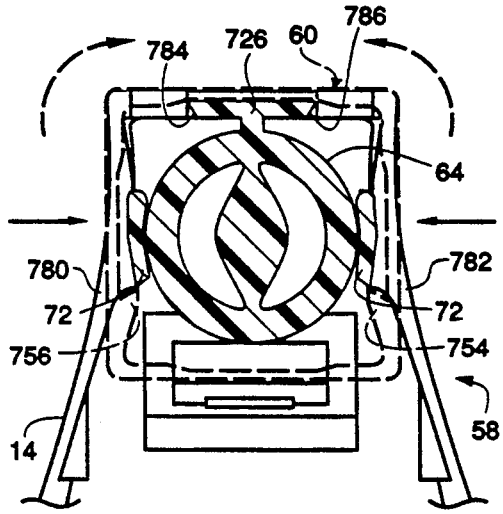
FIG. 12 is a vertical sectional view through the nozzle assembly, similar to the view shown in FIG. 11, but showing the side walls of the sprayer body squeezed in to move two legs or prongs extending from the body out of blocking position relative to two lugs on the inner wall of the nozzle cap.

The blocking position of the prongs 72 is shown in FIG. 11. Then, as shown in FIG. 12, when the wall areas 780 and 782 of the body 14 are squeezed or pushed inwardly to move the legs or prongs 72 toward the cylindrical portion 64 and out of blocking or catching engagement with the lugs 754 and 756, the nozzle cap 60 can be rotated clockwise or counterclockwise, as shown in phantom in FIG. 12.

Figure 13:
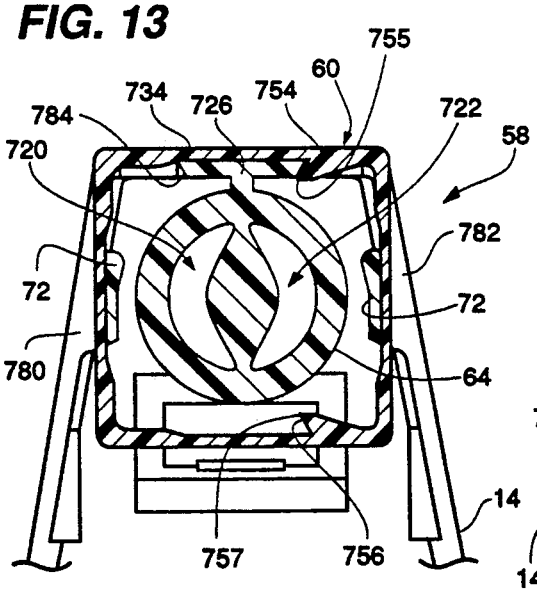
FIG. 13 is a vertical sectional view through the nozzle assembly, similar to the view shown in FIG. 11, and shows the nozzle cap after it has been rotated counterclockwise 90° to place the left side wall of the nozzle cap facing upwardly to indicate a SPRAY position of the nozzle cap.

As shown in FIG. 13, after the wall areas 780 and 782 are squeezed to move the legs 72 out of blocking engagement with respect to the lugs 754 and 756, particularly the lug 754, the nozzle cap 60 can be rotated counterclockwise 90° to the SPRAY position.

In this position, the waterways 720 and 722 communicate through the slot 750 and the slot 706 to the cylindrical cavity 704 for effecting a swirl of liquid to the outlet orifice 752 in the front wall 744 of the nozzle cap 60 thereby to effect the SPRAY , mist or fog-like discharge of liquid from the nozzle cap 60.

Figure 14:
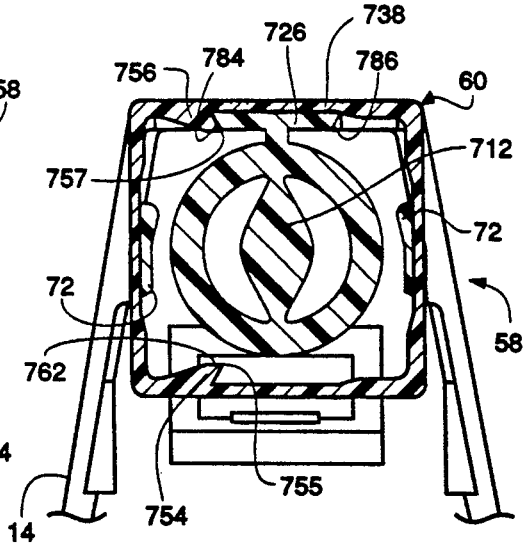
FIG. 14 is a vertical sectional view of the nozzle cap, similar to the view of the nozzle cap assembly shown in FIG. 11, but showing the nozzle cap rotated clockwise 90° to place the right side wall of the nozzle cap facing upwardly to indicate a STREAM position of the nozzle cap.

Then, FIG. 14 shows the nozzle cap 60 rotated clockwise 90° after the prongs or legs 72 have been squeezed inwardly so that the lug or projection 756 can move past the leg 72 to the position shown in FIG. 14 when the nozzle cap 60 is rotated clockwise.

Each lug 754, 756 has an upper surface 760 extending to a surface 762 that is close to parallel to the plane of the side wall 734 or 738, the intersection of these surfaces 760,762 being the edge or catch 755 or 757.

It will be noted that the extension tab 726 having inclined side edges 784 and 786 is adapted to engage on one side or the other the lug 754 or the lug 756 to prevent further rotation of the nozzle cap 60, counterclockwise or clockwise thereby to ensure that the nozzle cap 60 can only be moved from the STOP position to the SPRAY position or from the STOP position to the STREAM position.

From the foregoing description, it will be apparent that the nozzle assembly 58 of the present invention provides a child resistant trigger sprayer since the nozzle cap 60 cannot be rotated until the pull-away piece 20 is pulled out to remove the fork arms 69 from their position between the prongs or legs 72 and the cylindrical portion 64 of the nose bushing 16 thereby to permit inward deflection of the legs or prongs 72 when the body 14 is squeezed in the side wall areas 780 and 782 to move the legs or prongs 72 inwardly so that the nozzle cap 60 can be rotated from the STOP position to either the SPRAY position or the STREAM position. Accordingly, unless a child knows to squeeze the body 14 in the wall areas 780, 782 after the pull-away piece 20 has been removed, a child will not be able to rotate the cap 60 from the STOP position, such that a very effective child resistant trigger sprayer 10 is provided according to the teachings of the present invention.

Also, it will be apparent from the foregoing description that modifications can be made to the trigger sprayer 10 of the present invention and the structure for providing a child resistant sprayer without departing from the teachings of the present invention. Accordingly, the scope of the invention is only to be limited as necessitated by the accompanying claims.

We claim:

1. A trigger operated fluid dispensing device for mounting to a container, said dispensing device comprising:

a body having a front end including opposed side walls at the front end, a nose bushing extending from said front end between said side walls and at least one, elongate, nozzle cap blocking member which extends from said body front end and which is adapted to engage and prevent rotation of a nozzle cap upon rotation of the cap without manipulation of said body side walls;

a nozzle assembly at the front end of said body including said nose bushing, a nozzle cap received on said nose bushing and cooperating means on or in said nozzle cap and on or in said nose bushing for selectively establishing an off position of said nozzle cap, a spray position of said nozzle cap or a stream position of said nozzle cap upon rotation of said nozzle cap;

said nozzle cap being mounted for rotation on said nose bushing between said three positions and said nozzle cap having engaging means therein positioned adjacent said blocking member for engaging said blocking member when someone attempts to rotate said nozzle cap without manipulating said body side walls; and, said side walls of said body being deflectable inwardly of said body so that when said side walls are squeezed inwardly, they engage and move inwardly said blocking member to permit said engaging means in said nozzle cap to move past said blocking member when said nozzle cap is rotated at the same time said body side walls are squeezed.

2. The dispensing device of claim 1 wherein said at least one, elongate, blocking member includes at least one leg or prong extending outwardly from said front end of said body adjacent one of said side walls.

3. The dispensing device of claim 1 wherein said nozzle cap is generally cup-shaped including at least three cap side walls and a front wall, said front wall having an outlet orifice therein and at least one of said cap side walls having on an inner surface thereof a lug which is positioned to engage said blocking member and which defines said engaging means.

4. The dispensing device of claim 1 wherein said body has a top side wall and a tab extending from said top wall at the front end of said body and adapted to be received in said nozzle cap beneath the top wall thereof and having side edges at least one of which is adapted to engage said engaging means inside said nozzle cap to limit rotation of said nozzle cap, with such engagement defining an operating position of said nozzle assembly.

5. The dispensing device of claim 1 wherein said at least one, elongate, blocking member includes first and second prongs diametrically disposed on opposite sides of said nose bushing and extending outwardly from said front end of said body with each prong being disposed adjacent one of said side walls.

6. The dispensing device of claim 5 wherein each of said prongs is a generally flat flexible planar elongate leg which extends in a plane generally parallel to the plane of an adjacent side wall of said body and being deflectable inwardly toward said nose bushing when said body side walls are squeezed thereby to move said prongs out of a blocking position with respect to said engaging means in said cap.

7. The dispensing device of claim 5 wherein said nozzle cap is generally cup-shaped including at least three cap side walls and a front wall, said front wall having an outlet orifice therein, said cap side walls comprising a cap top side wall having STOP indicia thereon on the outer surface thereof, a cap left side wall having SPRAY indicating indicia thereon and a cap right side wall having STREAM indicating indicia thereon, and said cap left and right side walls each having on an inner surface thereof a lug positioned to engage the side of one of said prongs, said lugs defining said engaging means.

8. The dispensing device of claim 7 wherein each of said lugs is defined by a projection which extends from the inner surface of one of said nozzle cap side walls and has a sharp edge or catch edge defined between a first surface extending inwardly of said cap from said inner surface of said nozzle cap side wall and another surface generally parallel to said nozzle cap side wall.

9. The dispensing device of claim 1 wherein said body has a top wall and said device includes tamper evident means releasably fixed to said top wall and including means for engaging said nozzle cap and grippable means for enabling one to grip said tamper evident means and pull same away from said top wall.

* * * * *